United States Patent [19]

Yasuoka et al.

[11] Patent Number: 5,027,094

[45] Date of Patent: Jun. 25, 1991

[54] ELECTROMAGNETIC RELAY

[75] Inventors: Yuji Yasuoka, Kyoto; Yoshiharu Kitagawa, Kanzaki; Yoshikiyo Imai, Moriyama, all of Japan

[73] Assignee: Omron Tateisi Electronics Co., Kyoto, Japan

[21] Appl. No.: 496,136

[22] Filed: Mar. 19, 1990

Related U.S. Application Data

[63] Continuation of Ser. No. 320,506, Mar. 8, 1989, abandoned.

[30] Foreign Application Priority Data

Mar. 9, 1988 [JP] Japan ..... 63-57272

[51] Int. Cl.[5] ..... H01H 51/28

[52] U.S. Cl. ..... 335/78; 335/83; 335/202

[58] Field of Search ..... 335/78-85, 335/104-106, 162, 202, 250

[56] References Cited

U.S. PATENT DOCUMENTS 4,578,660 3/1986 Hanada et al. ..... 335/162
4,688,010 8/1989 Nobutuki et al. ..... 335/128
4,707,675 11/1987 Motoyama et al. ..... 335/128

*Primary Examiner*—Leo P. Picard
*Assistant Examiner*—Lincoln Donovan
*Attorney, Agent, or Firm*—Fish & Richardson

[57] ABSTRACT

An electromagnetic relay, comprising: a box-shaped casing having a bottom wall, a pair of side walls, a pair of end walls, and a top wall, an electromagnet unit received in the casing with its axial direction extending in parallel with the top, bottom and side walls of the casing; and at least one contact unit mounted on the top wall; one of the end walls being provided with an opening for receiving the electromagnet unit therefrom. The inner surfaces of the side walls of the casing are provided with guide grooves extending along a longitudinal direction of the casing for guiding side ends of the yoke when receiving the electromagnet unit into the casing. Thus, simply by press fitting only the electromagnet unit from the opening provided in one of the end walls of the casing, the electromagnet unit may be securely received in the box-shaped casing. This facilitates the required assembly work and permits the use of automated machines for the assembly work. Typically, the electromagnet unit is fixedly and sealingly secured in the casing with an adhesive agent.

13 Claims, 7 Drawing Sheets

ELECTROMAGNETIC RELAY

This application is a continuation of U.S. application Ser. No. 07/320,506, filed Mar. 8, 1989, now abandoned.

TECHNICAL FIELD

The present invention relates to an electromagnetic relay and in particular to an assembly structure thereof which is easy to assemble but ensures a high level of operation reliability.

BACKGROUND OF THE INVENTION

The casings for conventional relays for sealingly receiving an electromagnet unit and a contact unit are typically provided with the shape of an elongated box. The casing is provided with an opening in its upper face for receiving an electromagnet, and a contact unit is typically fitted upon the casing from above. The armature of the electromagnet unit is typically L-shaped and is provided with a first portion extending in parallel with the electromagnet and a second portion extending across the magnetic gap defined between an end of the electromagnet and an adjacent end of a yoke associated therewith. The second portion of the armature is adapted to move so as to close and open the magnetic gap with the bending line of the armature resting upon an edge of the yoke acting as a hinge.

According to such a structure, since the electromagnet unit and the contact unit must be put together before they may be fitted into the casing, the assembly work requires skill and, in particular, is not very suitable to be performed with an automated assembly machine. As a matter of fact, when the assembly consisting of an electromagnet and a contact unit is to be fitted into a casing, the terminal pins extending from the contact unit must be passed through corresponding holes provided in the casing, and there is a chance of bending the terminal pins and thereby creating defective products when forcing the terminal pins into such holes with an automated machine.

BRIEF SUMMARY OF THE INVENTION

In view of such problems of the prior art, a primary object of the present invention is to provide an electromagnetic relay which is easy to assemble and can offer a high level of reliability at the same time.

A second object of the present invention is to provide an electromagnetic relay which is suitable for automated assembly processes.

A third object of the present invention is to provide an electromagnetic relay having a highly compact profile by minimizing internal dead space thereof.

These and other objects of the present invention can be accomplished by providing an electromagnetic relay, comprising: a box-shaped casing having a bottom wall, a pair of side walls, a pair of end walls, and a top wall; an electromagnet unit received in the casing with its axial direction extending in parallel with the top, bottom and side walls of the casing; and at least one contact unit mounted on the top wall; one of the end walls being provided with an opening for receiving the electromagnet unit therefrom.

Thus, according to the present invention, simply by press fitting only the electromagnet unit from the opening provided in one of the end walls of the casing, the electromagnet unit may be securely received in the box-shaped casing. Typically, the electromagnet unit is fixedly and sealingly secured in the casing with an adhesive agent.

After the electromagnet unit is fitted into the casing, a plurality of contact terminal pieces may passed from the top wall to the bottom walls through at least one of the side walls, and project from the bottom wall as terminal pins. Therefore, fitting of the terminal pins may be separately performed from fitting of the electromagnet unit, and the possibility of deforming the terminal pins is substantially reduced.

In order to ensure the facility of fitting the electromagnet unit into the casing without requiring undesirable plays, inner surfaces of the side walls of the casing may be provided with guide grooves extending along a longitudinal direction of the casing for guiding side ends of the yoke of the electromagnet unit when receiving the electromagnet unit into the casing. To improve the friction property between the side ends of the yoke and the internal surface of the guide grooves, the side ends of the yoke may be provided with projections which are adapted to slide over the inner surfaces of the guide grooves.

A particularly advantageous structure is produced if the lower boundary of each of the guide grooves adjacent to the electromagnet unit receiving end of the casing is removed so as to permit abutting of a front end of each of the side ends of the yoke to a corresponding upper boundary surface of the guide groove from an oblique lower direction, because the positioning of the electromagnet unit relative to the casing when the electromagnetic unit is about to be inserted into the casing can be achieved in a simple manner. This feature is helpful in simplifying the process of fitting the electromagnet unit into the casing. Such a groove structure can be realized in a very simple fashion if each of the grooves is defined by a pair of ribs projecting from the inner surface of the corresponding side wall along the longitudinal direction of the casing, and the lower rib stops short of the electromagnet unit receiving end of the casing.

In order to snugly receive the electromagnet unit in the casing, it is preferred that the end wall opposite to the electromagnet unit receiving end of the casing is provided with an opening adapted to receive the front end of an iron core of the electromagnet unit when it is received in the casing. This feature not only minimizes the amount of dead space inside the casing but also improves the accuracy of the position of the electromagnet unit inside the casing. Furthermore, when the electromagnet unit is desired to be removed from the casing, it can be simply accomplished by pushing the front end of the iron core from outside of the casing.

A particularly favorable arrangement can be accomplished if the electromagnet unit is provided with an iron core, a coil wound thereon, a yoke having a front end portion securely attached to the front end of the iron core, a middle portion extending along the top side of the coil, and a rear end portion terminating adjacent the rear end of the iron core, an armature which is L-shaped by having a first portion extending substantially in parallel with the middle portion of the yoke and a second portion extending across a magnetic gap defined between the rear end portion of the yoke and the rear end of the iron core, the first and second portions of the armature being connected to each other by a substantially perpendicularly bent portion resting upon and supported by the rear end portion of the yoke in the manner of a hinge, and a sheet spring secured to the rear end of the casing and having arms extending therefrom to urge the bent portion of the armature against the rear end of the yoke.

If the sheet spring is provided with at least an upper arm which bears upon the bent portion of the armature to urge the armature to be kept hinged upon the rear end of the yoke, a pair of lateral tangs provided in a middle part of the sheet spring to be elastically attached to corresponding parts of the casing, and at least one spacer piece provided in a lower part of the sheet spring to abut a part of the casing, the reaction which the sheet spring receives from the armature is favorably supported by the spacer piece abutting the casing, and the sheet spring becomes better capable of applying effective spring force to the armature. In this conjunction it is desirable if the lateral tangs are provided with openings which are adapted to fit upon corresponding projections provided in the casing so that the lateral tangs function as an fulcrum. A favorable guiding action for the motion of the armature is produced by using a pair of spacer pieces projecting from the sheet spring so as to restrict lateral movement of the second portion of the armature.

If a pair of moveable contact pieces are required to be activated at the same time, it is preferable if the contact unit comprises at least a pair of laterally spaced and longitudinally extending moveable contact pieces, and a pressure member for moving the moveable contact pieces is pivotally attached to the front end of the first part of the armature for a rotary motion around an axial line extending in parallel with the longitudinal line of the electromagnet unit so that any uneveness in the positional accuracy of the moveable contact pieces may be accommodated by the rotational motion of the pressure member and the two contact pieces may be activated substantially at the same time. If the pressure member is provided with a pair of projections which directly bear upon the moveable contact pieces substantially by point contact, it also becomes possible to accommodate any twisting in the moveable contact pieces.

BRIEF DESCRIPTION OF THE DRAWINGS

Now the present invention is described in terms of a specific embodiment with reference to the appended drawings, in which.

DESCRIPTION OF THE PREFERRED EMBODIMENT

Figure 1:
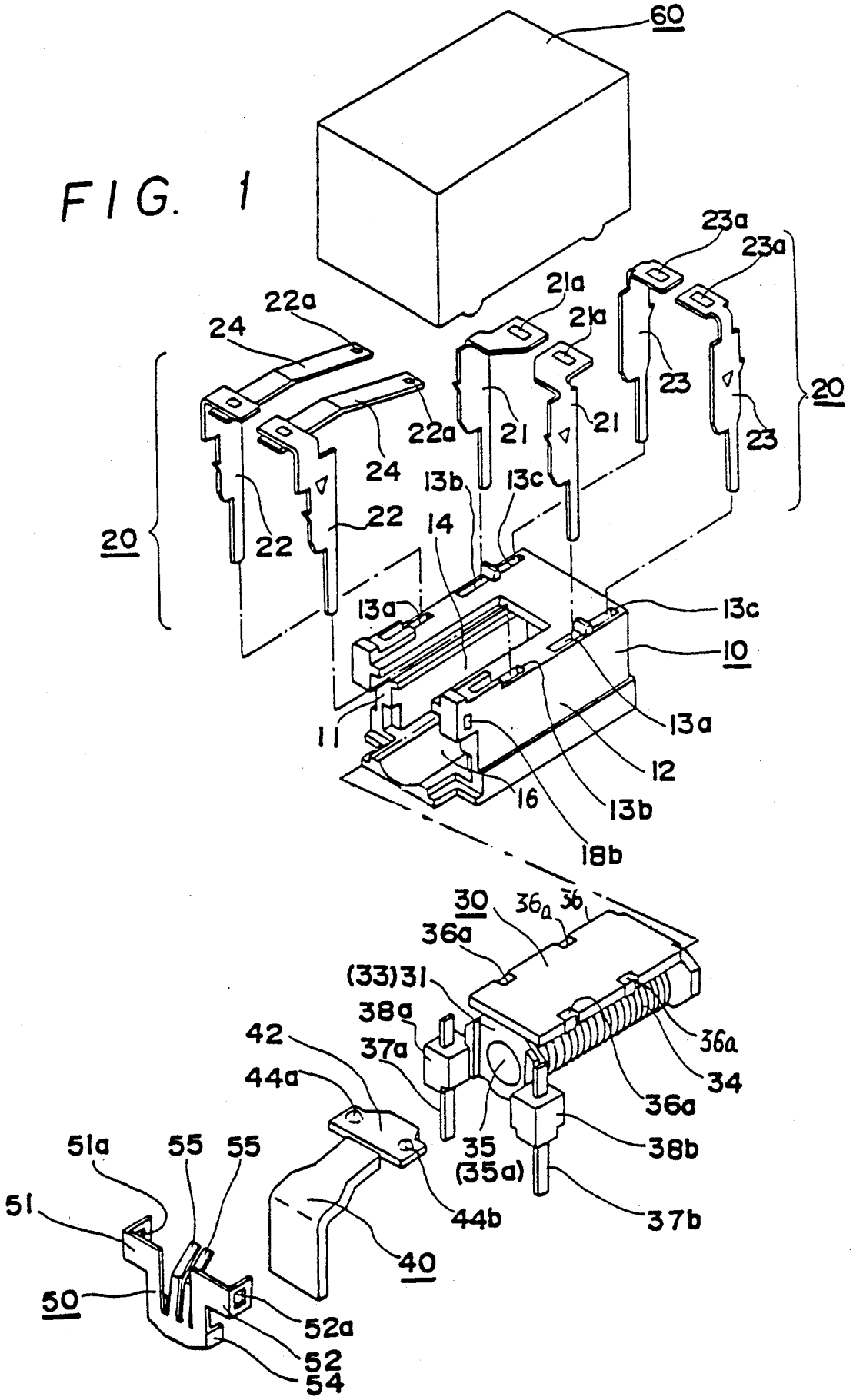
FIG. 1 is an exploded perspective view of an embodiment of the electromagnetic relay according to the present invention.
Figure 2:
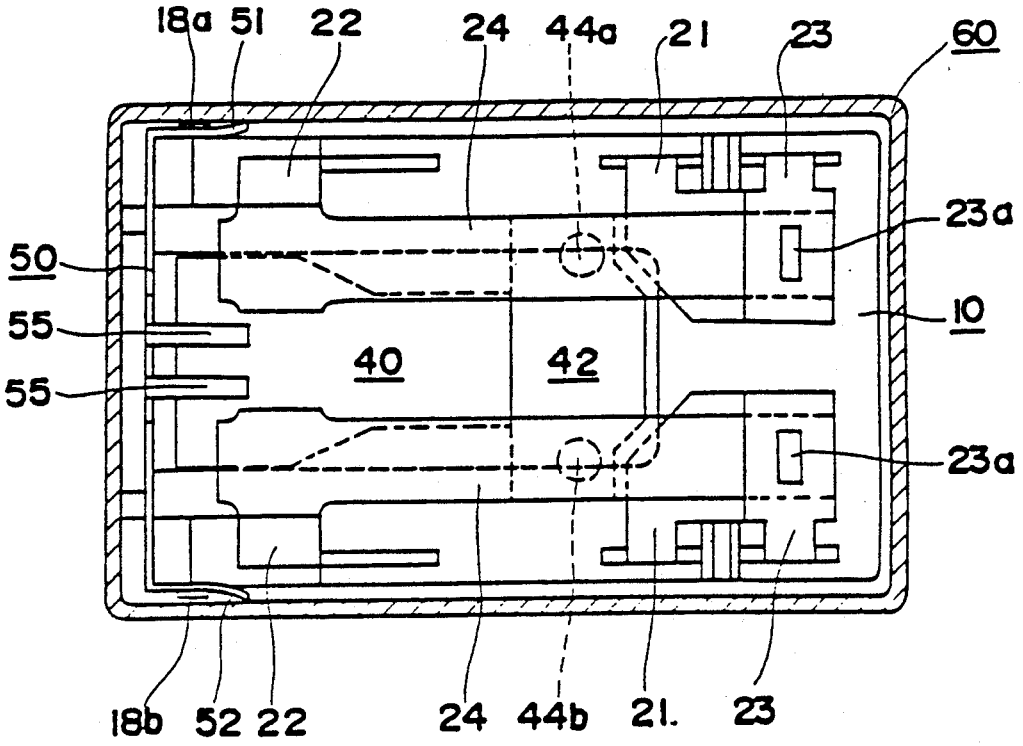
FIG. 2 is a sectional plan view of the electromagnetic relay.

Referring to FIG. 1, the electromagnetic relay of the present embodiment substantially consists of a box-shaped casing 10, a pair of contact units 20 and 20, an electromagnet unit 30, an armature 40, a hinge spring 50 and a cover 60.

Figure 7:
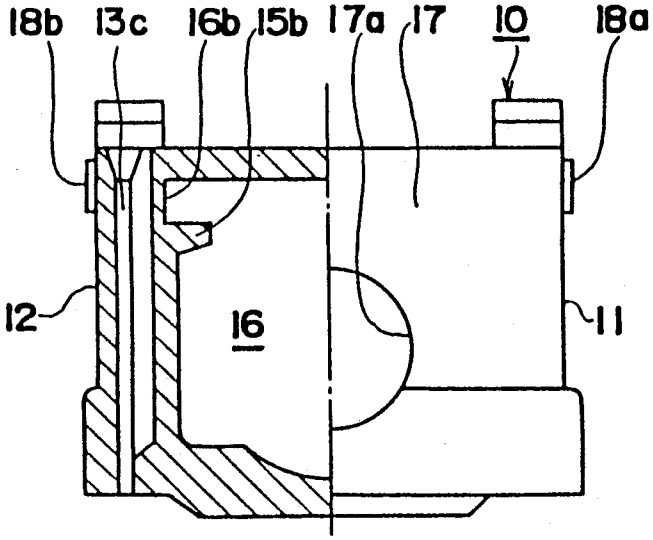
FIG. 7 is a sectional view taken along line VII—VII of FIG. 5.
Figure 6:
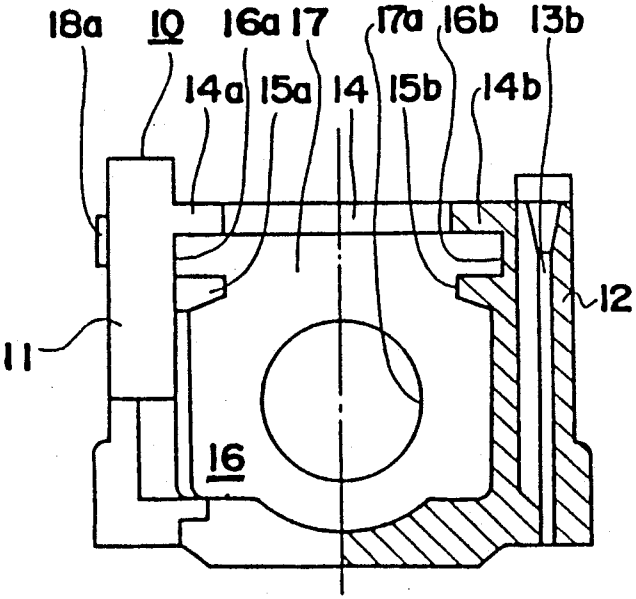
FIG. 6 is a sectional view taken along line VI—VI of FIG. 5.

As shown in FIGS. 1 through 8, the box-shaped casing 10 has a substantially C-shaped cross section, and comprises terminal holes 13*a*, 13*b* and 13*c* which are vertically passed through mutually opposing side walls 11 and 12. A pair of guide grooves 16*a* and 16*b* communicating with an opening 16 provided in one of its end walls are defined between side fringes 14*a* and 14*b* of an upper opening 14 provided in a top wall of the casing 10 and ribs 15*a* and 15*b* projecting from the opposing inner surfaces of the side walls 11 and 12 of the casing 10, respectively, and a through hole 17*a* is provided in the other end wall 17 of the casing 10 (FIGS. 6 and 7). The through hole 17*a* has a larger diameter than an end portion 35*b* of an iron core 35 (FIG. 8) which is described hereinafter.

Figure 8:
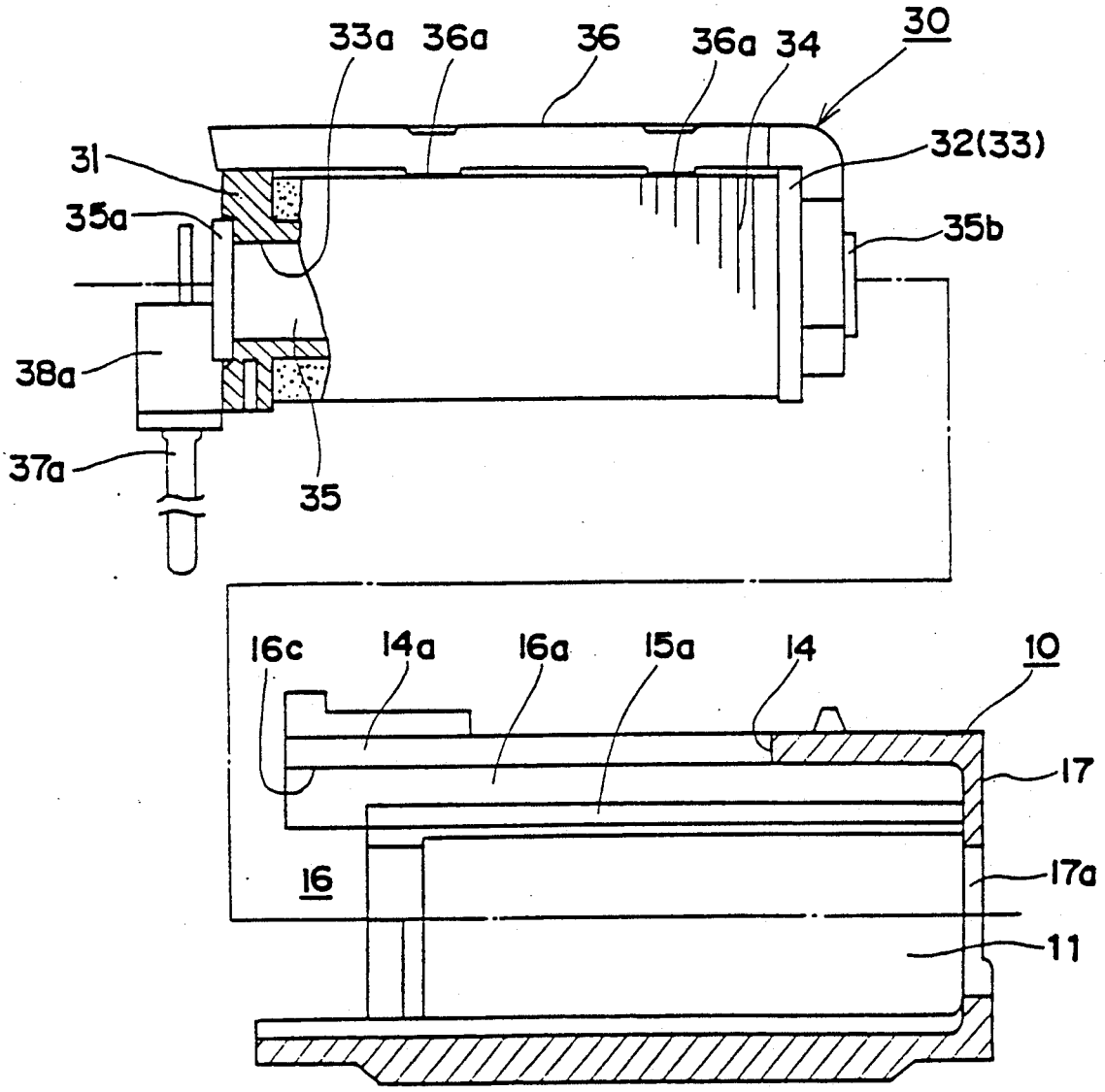
FIG. 8 is a partly broken away assembly view of the casing and the electromagnet unit.

By arranging the ribs 15*a* and 15*b* slightly short of the end wall opening 16 and making them shorter that the fringe portions 14*a* and 14*b* so as to define steps therebetween, the lower surfaces 16*c* of the end portions of the fringe portions 14*a* and 14*b* are exposed as seen obliquely from below (FIG. 8). This is for facilitating the positioning of the electromagnet unit 30 as described hereinafter.

The parts of the outer surfaces of the mutually opposing side walls 11 and 12 of the box-shaped casing 10 adjacent the end wall opening 16 are provided with projections 18*a* and 18*b* to engage the hinge spring 50 as described hereinafter.

The contact units 20 and 20 are arranged laterally on either side of the upper surface of the casing 10 by press fitting normally closed fixed contact terminal pieces 21, moveable contact terminal pieces 22 and normally open contact terminal pieces 23 into the terminal holes 13*a*, 13*b* and 13*c* of the casing 10.

Figure 3:
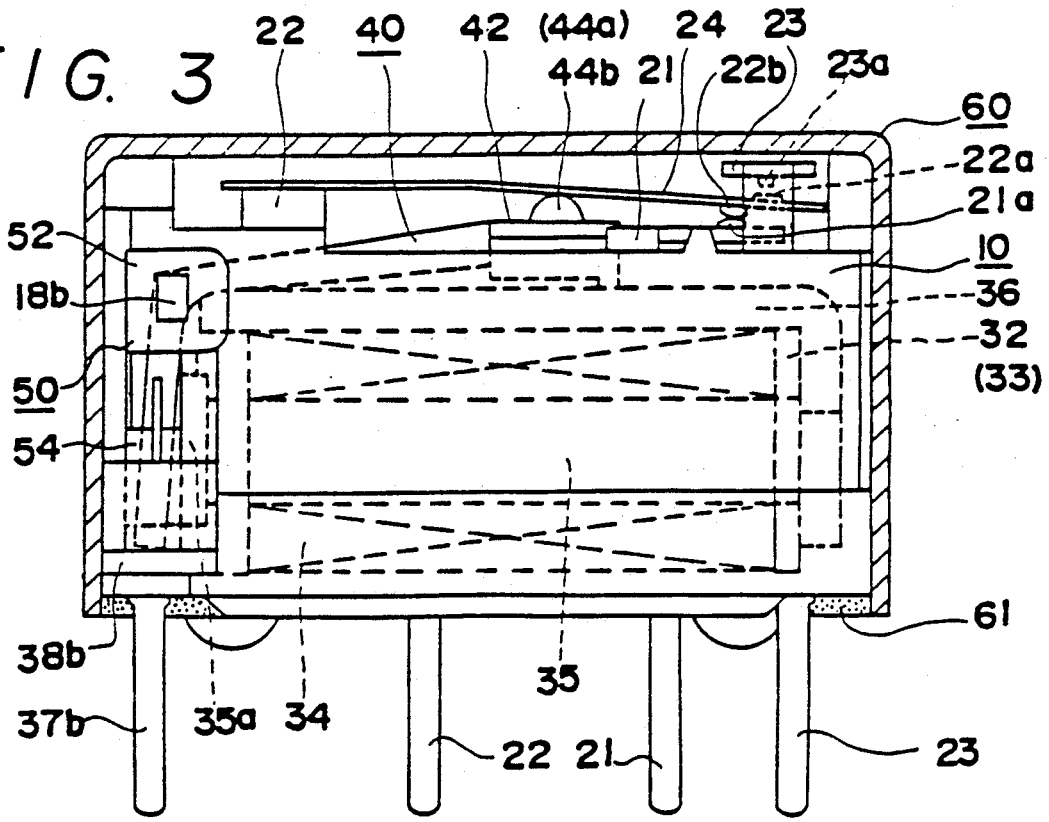
FIG. 3 is a sectional side view of the electromagnetic relay.
Figure 4:
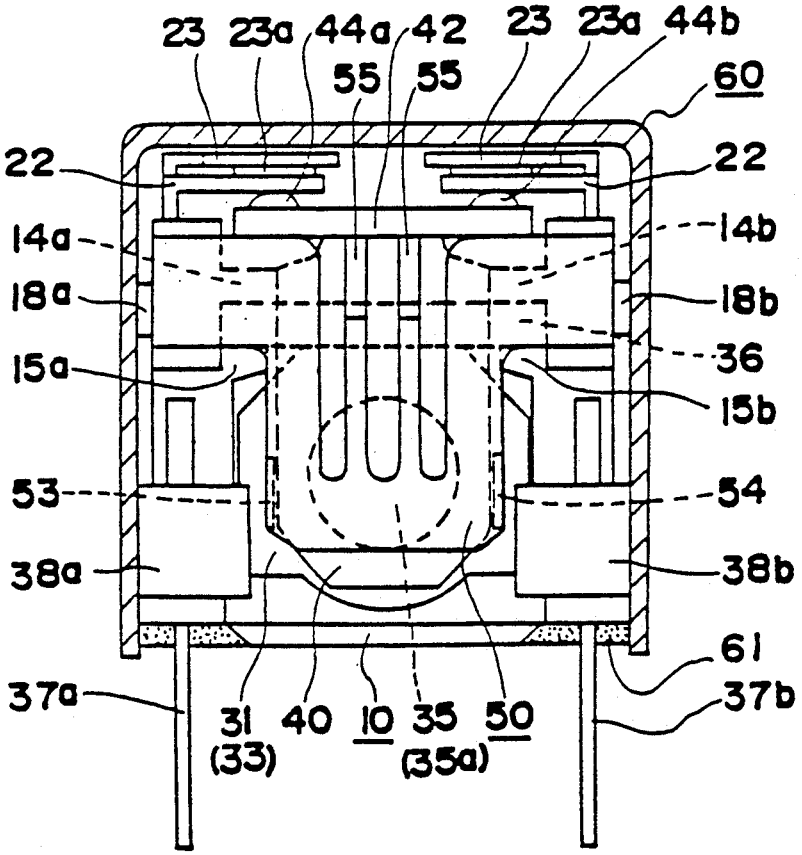
FIG. 4 is a sectional front view of the electromagnetic relay.
Figure 5:
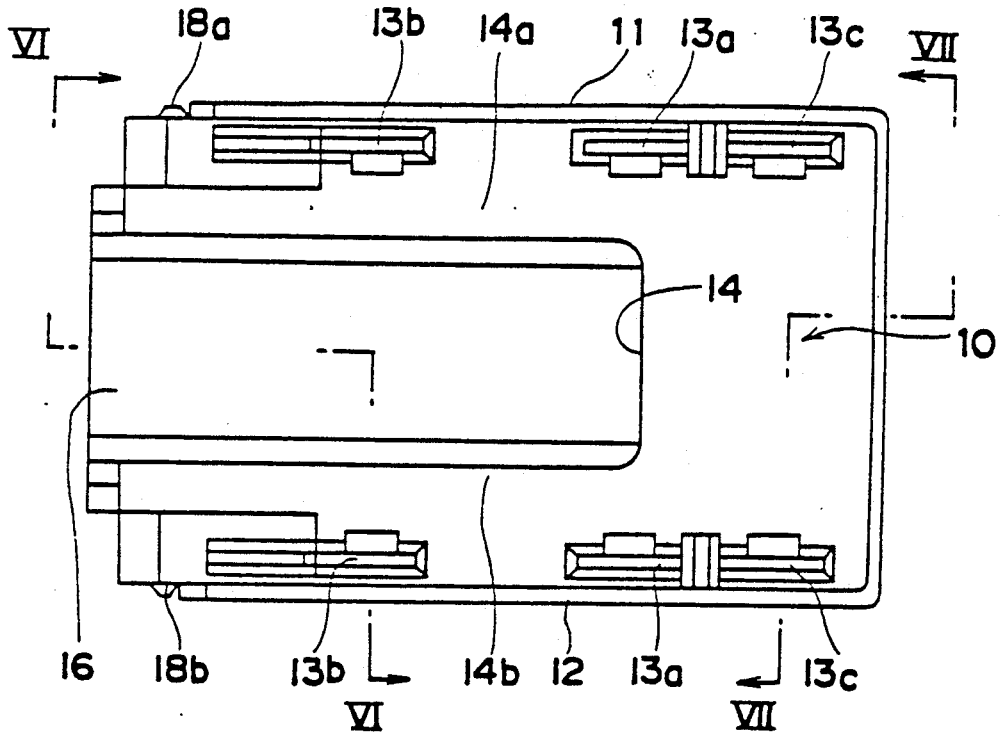
FIG. 5 is a plan view of the casing.

In particular, the base ends of moveable contact pieces 24 are welded to upper parts of the moveable contact piece terminals 22, respectively, and the free ends of the moveable contact pieces 24 are provided with moveable contacts 22*a* and 22*b*, respectively, which are adapted to selectively contact either normally closed fixed contacts 21*a* of the normally closed fixed contact terminal pieces 21 or normally open fixed contacts 23*a* of the normally open fixed contact terminal pieces 23 (FIG. 3).

In regards to the contact terminal pieces forming the contact units 20, as possible alternative embodiments, the normally closed fixed contact terminal pieces 21 may be insert molded in the box-shaped casing 10 in advance, or, alternatively, a contact block may be formed by integrally molding the normally closed fixed contact terminal pieces 21, the moveable contact terminal pieces 22 and the normally open fixed contact terminal pieces 23 by resin, and securely press fitting this assembly into the casing 10.

As shown in FIG. 8, the electromagnet unit 30 is provided with a coil 34 wound around a spool 33 having flanges 31 and 32 on either end thereof, and an iron core 35 having a large-diameter portion 35*a* at its rear end is passed through the central hole 33*a* of the spool 33. The large-diameter portion 35*a* of the iron core 35 is formed as a magnetic pole portion 35*a* and the other end portion 35*b* protruding from the casing 10 is crimped to a vertical part of an L-shaped yoke 36.

From either side of one of the flanges 31 of the spool 33 located at its rear end project a pair of pedestals 38*a* and 38*b* in which coil terminals 37*a* and 37*b* are insert molded. The side fringes of the horizontal part of the yoke 36 are provided with projections 36*a* and 36*a* by press forming.

Thus, after abutting the outer side portions of the front ridge of the yoke 36 to the lower surfaces 16*c* of the end portions of the fringes 14*a* and 14*b* adjoining the end wall opening 16 of the casing 10 for positioning purpose obliquely from below, the side fringes of the yoke 36 are fitted into the guide grooves 16*a* and 16*b* with the projections 36*a* and 36*a* of the yoke 36 applying appropriate pressure to the guide grooves 16*a* and 16*b* until the other end 35*b* of the iron core 35 which is crimped to the yoke 36 is received in the through hole 17*a* provided in the other end wall of the casing 10 and the vertical portion of the yoke 36 abuts the inner surface of the end wall 17 of the casing 10. Therefore, the advantage of creating substantially no dead space is obtained.

Furthermore, according to the present embodiment, since stepped parts are formed by removing parts of the ribs 15*a* and 15*b* between rearmost ends of the ribs 15*a* and 15*b* and the fringe portions 14*a* and 14*b* for the purpose of facilitating the positioning of the electromagnet unit 30 before inserting it into the casing 10, the positioning work is simplified as it can be accomplished by abutting the side portions of the front ridge portion of the yoke 36 to the lower surfaces 16*c* of the end portions of the grooves 16*a* and 16*b*, whereby not only the assembly work is simplified but also there is a less chance of catching a part of the coil 34 with the fringes of the end wall opening 16 of the casing 10 and breaking the coil wire.

Since the electromagnet unit 30 is fitted into the guide grooves 16*a* and 16*b* of the casing 10 by way of the projections 36*a* and 36*a* of the yoke 36, the electromagnet unit 30 may be securely fitted into the casing 10 with a favorable friction property and substantially without any play as an additional advantage.

When the electromagnet unit 30 is to be pulled out from the casing 10, since it can be accomplished simply by pushing the iron core 35 through the through hole 17*a* from outside and there is no need to pull the pedestals 38*a* and 38*a* of the spool 33 or the like, the chance of damaging the spool 33 and other parts when removing the electromagnet unit 30 is reduced.

Figure 9:
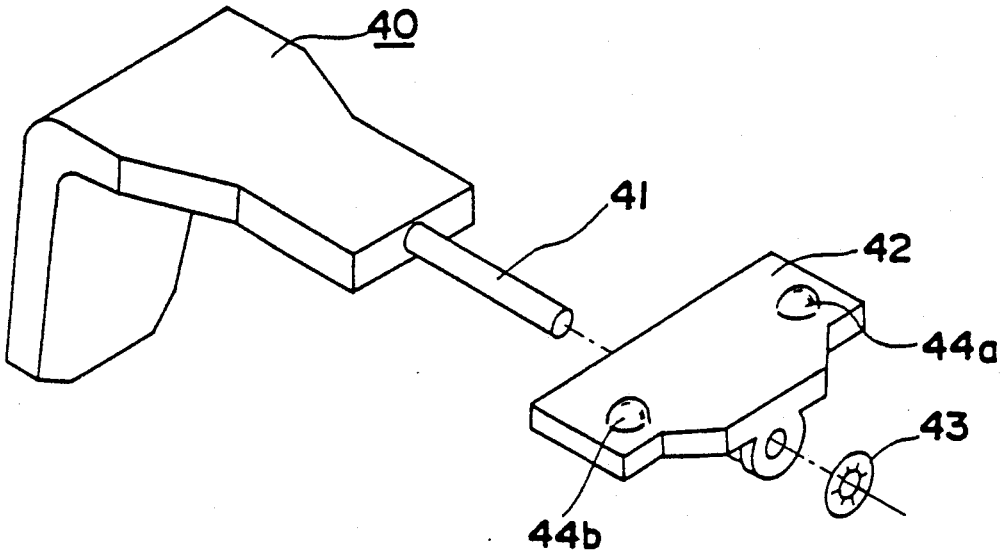
FIG. 9 is an exploded perspective view of the armature provided with the pressure member.

Referring to FIG. 9, the armature 40 consists of a punched out metallic plate which is bent substantially into the shape of letter L, and a pressure member 42 is rotatably supported by a shank 41 provided at the free end of the horizontal part of the armature 40, with a stop ring 43 preventing the pressure member 42 from being pulled off from the shank 41. The upper surface of the pressure member 42 is provided with a pair of laterally spaced projections 44*a* and 44*b* which are adapted to press upon central parts of the corresponding moveable contact pieces 24 and 24.

Therefore, when the pressure member 42 of the armature 40 is placed between the moveable contact pieces 24 and 24 and the fringe portions 14*a* and 14*b* of the casing 10, the armature 40 is snugly positioned between the fringe portions 14*a* and 14*b*. Further, the inner corner of the armature 40 rests upon the corner ridge of the free end of the yoke 36, and the vertical part of the armature 40 can therefore move toward and away from the magnetic pole portion 35*a* of the iron core 35.

Figure 10:
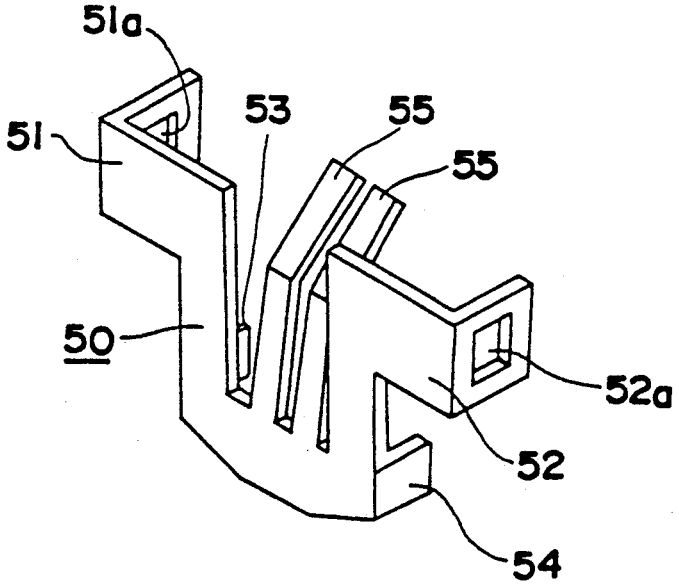
FIG. 10 is a perspective view of the hinge spring.

Referring to FIG. 10, the hinge spring 50 is substantially conformal to the vertical portion of the armature 40 as seen from one end of the casing 10, and is provided with a pair of lateral pieces 51 and 52 cut out therefrom at either side of its middle part, and a pair of spacer pieces 53 and 54 which oppose each other at either side of a lower part of the hinge spring 50. Further, the hinge spring 50 is provided with a pair of arms 55 and 55 which are cut out from an upper central part of the hinge spring 50 and bent inwardly to be elastically pressed upon the ridge portion of the armature 40 defined between its vertical and horizontal portions. The free ends of the lateral tangs are bent inwardly by right angle, and are each provided with an opening 51*a* or 52*a* which fits onto the corresponding projection 18*a* or 18*b* provided in the casing 10 as mentioned earlier.

Therefore, by engaging the engagement holes 51*a* and 52*a* provided in the lateral tangs 51 and 52 with the projections 18*a* and 18*b* of the casing 10, the arms 55 and 55 can press upon the ridge part of the armature 40 so as to urge the armature 40 to be supported by the rear end of the yoke 36 in the manner of a hinge, and by restricting the lateral end surfaces of the armature 40 with the spacer pieces 53 and 54, the lateral movement thereof is restricted so as to prevent the generation of chips as a result of friction between the armature 40 and the casing 10.

Further, the spacer pieces 53 and 54 of the hinge spring 50 engage the side portions of the rear end surface of the flange 31 thereby defining a gap between the hinge spring 50 and the rear surface of the vertical part of the armature 40. Therefore, due to the reaction from the arms 55 and 55 which apply pressure to the side portions of the corner part of the armature 40, even when a bending moment is applied to the hinge spring 50, this bending moment is born by the spacer pieces 53 and 54 without affecting the movement of the armature 40, and this is advantageous because it eliminates the possibility of any failure in the operation of the armature 40.

The cover 60 is provided with a box shape which is adapted to be fitted onto the casing 10, and a sealant 61 is used to sealingly and fixedly secure the cover 60 to the casing 10.

Now the operation of the electromagnetic relay of the present embodiment is described in the following.

In de-energized state, the pressure member 42 is pressed down by the spring force of the moveable contact pieces 24 and 24, and the vertical part of the armature 40 is removed away from the magnetic pole portion 35*a* of the iron core 35 while the moveable contacts 22*a* are in contact with the normally closed fixed contacts 21*a*.

When the coil 34 is energized, the vertical part of the armature 40 is attracted to the magnetic pole portion 35*a* of the iron core 35, and the armature 40 thereby rotates about the ridge portion of the free end of the yoke 36 against the spring force of the moveable contact pieces 24 and 24. It then follows that the projections 44*a* and 44*b* of the pressure member 42 push up the moveable contact pieces 24 and 24 and, after the moveable contacts 22*a* are displaced from the normally closed fixed contacts 21*a*, come into contact with the normally open fixed contacts 23*a*.

When the coil 34 is de-energized, the armature 40 rotates back to its initial position under the spring force of the moveable contact pieces 24 and 24.

According to the present embodiment, since the projections 44*a* and 44*b* of the pressure member 42 push up the lower surfaces of the moveable contact pieces 24 and 24 substantially by point contact, even when the moveable contact pieces 24 and 24 are assembled in twisted state or the pressure member 42 is inclined, the side ends of the moveable contact pieces 24 and 24 would not unevenly contact the pressure member 42 and the possibility of generating chips by friction is eliminated.

Furthermore, since the pressure member 42 is rotatably mounted on the armature 40, even when there is a variation in the positioning accuracy of the moveable contact pieces 24 and 24, the pressure member 42 is brought into contact with the moveable contact pieces 24 and 24 substantially at the same time, and the variation in the opening and closing timing of the contacts is eliminated as an additional advantage.

Although the above described embodiment pertained to the case where two pairs of contact units are provided above an electromagnet unit, the present invention is no way limited thereby, and only one contact unit may be provided as a matter of course.

As one can readily understand from the above description, according to the present invention, since only the electromagnet unit is required to be positioned and fitted into an end wall opening of a box-shaped casing having a C-shaped cross section, the process of positioning and fitting the electromagnet unit can be performed with less effort than was possible heretofore.

Furthermore, since the contact unit and the electromagnet unit can be mounted on the casing individually, the adjustment of their positioning is simplified and the possibility of defective products is reduced.

What is claimed is:

1. An electromagnetic relay, comprising a box-shaped casing having a bottom wall, a pair of side walls each having an inner surface, a pair of end walls, and a top wall;

an electromagnet unit received in said casing with its axial direction extending in parallel with said top, bottom and side walls of said casing;

at least one contact unit mounted on said top wall;

one of said end walls being provided with an opening for receiving said electromagnet unit therein;

each said inner surface of said side walls of said casings having a guide groove with an interior surface extending along a longitudinal direction of said casing for receiving and guiding said electromagnet unit into said casing.

2. An electromagnetic relay according to claim 1, wherein said electromagnet unit is fixedly and sealingly secured in said casing with an adhesive agent.

3. An electromagnetic relay according to claim 1, wherein a plurality of contact terminal pieces are passed from said top wall to said bottom walls through at least one of said side walls, and project from said bottom wall as terminal pins.

4. An electromagnetic relay according to claim 1, wherein said electromagnet unit is provided with an iron core, a coil wound thereon, and a yoke extending from one end of said iron core to a vicinity of the other end of said iron core along an upper side of said coil, said yoke having first and second side fringes each having at least one projection adapted to slide over said interior surface of said guide groove, said guide grooves for guiding said side fringes of said yoke when receiving said electromagnet unit into said casing.

5. An electromagnetic relay according to claim 4, wherein the lower boundary of each of said guide grooves adjacent to the electromagnet unit receiving end of said casing is removed so as to permit abutting of a front end of each of said side fringes of said yoke to a corresponding upper boundary surface of said guide groove from an oblique lower direction.

6. An electromagnetic relay according to claim 5, where each of said grooves is defined by a pair of ribs projecting from the inner surface of the corresponding side wall along the longitudinal direction of said casing, and the lower rib stops short of said electromagnet unit receiving end of said casing.

7. An electromagnetic relay according to claim 1, wherein the end wall opposite to the electromagnet unit receiving end of said casing is provided with an opening adapted to receive the front end of an iron core of said electromagnet unit when it is received in said casing.

8. An electromagnetic relay according to claim 1, wherein said electromagnet unit is provided with an iron core, a coil wound thereon, a yoke having a front end portion securely attached to said front end of said iron core, a middle portion extending along the top side of said coil, and a rear end portion terminating adjacent the rear end of said iron core, an armature which is L-shaped by having a first portion extending substantially in parallel with said middle portion of said yoke and a second portion extending across a magnetic gap defined between said rear end portion of said yoke and said rear end of said iron core, said first and second portions of said armature being connected to each other by a substantially perpendicularly bent portion resting upon and supported by said rear end portion of said yoke in the manner of a hinge, and a sheet spring secured to said rear end of said casing and having arms extending therefrom to urge said bent portion of said armature against said rear end of said yoke.

9. An electromagnetic relay according to claim 8, wherein said sheet spring is provided with at least an upper arm which bears upon said bent portion of said armature to urge said armature against said rear end of said yoke, a pair of lateral tangs provided in a middle part of said sheet spring to be elastically attached to corresponding parts of said casing, and at least one spacer piece provided in a lower part of said sheet spring to abut a part of said casing.

10. An electromagnetic relay according to claim 9, wherein a pair of spacer pieces are provided in said sheet spring so as to restrict lateral movement of said second portion of said armature.

11. An electromagnetic relay according to claim 9, wherein said lateral tangs are provided with openings which are adapted to fit upon corresponding projections provided in said casing.

12. An electromagnetic relay according to claim 1, wherein said contact unit comprises at least a pair of laterally spaced and longitudinally extending moveable contact pieces, and a pressure member for moving said moveable contact pieces is pivotally attached to the front end of said first part of said armature for a rotary motion around an axial line extending in parallel with said longitudinal line of said electromagnet unit.

13. An electromagnetic relay according to claim 1, wherein said pressure member is provided with a pair of projections which directly bear upon said moveable contact pieces substantially by point contact.

* * * * *